US007802572B2

(12) United States Patent
Hahne

(10) Patent No.: US 7,802,572 B2
(45) Date of Patent: Sep. 28, 2010

(54) FACE MASK

(75) Inventor: Jeanne Hahne, San Francisco, CA (US)

(73) Assignee: Sutter West Bay Hospitals, San Francisco, CA (US)

( * ) Notice: Subject to any disclaimer, the term of this patent is extended or adjusted under 35 U.S.C. 154(b) by 178 days.

(21) Appl. No.: 11/663,100

(22) PCT Filed: Sep. 20, 2005

(86) PCT No.: PCT/US2005/033534

§ 371 (c)(1),
(2), (4) Date: Mar. 15, 2007

(87) PCT Pub. No.: WO2006/034227

PCT Pub. Date: Mar. 30, 2006

(65) Prior Publication Data

US 2008/0092909 A1 Apr. 24, 2008

Related U.S. Application Data

(60) Provisional application No. 60/611,856, filed on Sep. 20, 2004.

(51) Int. Cl.
*A62B 23/02* (2006.01)
*A62B 18/08* (2006.01)
*A61F 11/00* (2006.01)

(52) U.S. Cl. ..... 128/206.19; 128/206.12; 128/857

(58) Field of Classification Search ..... 2/206, 2/7, 9, 173, 424, 2.1, 6, 10, 171, 455, 410, 2/8.1; 128/206.19, 863, 139, 206.12, 201.23, 128/201.24, 201.25, 201.27, 201.28, 201.29, 128/857, 846, 203.13, 206.16, 206.17, 205.25, 128/206.21, 206.27, 206.28
See application file for complete search history.

(56) References Cited

U.S. PATENT DOCUMENTS

| | | | | |
|---|---|---|---|---|
| 3,500,825 A * | 3/1970 | Andersson et al. | ..... | 128/863 |
| 3,695,265 A | 10/1972 | Brevik | | |
| 4,296,746 A | 10/1981 | Mason, Jr. | | |
| 4,315,335 A * | 2/1982 | Kennedy et al. | ..... | 2/424 |
| 4,323,063 A * | 4/1982 | Fisichella | ..... | 128/863 |
| 4,467,799 A | 8/1984 | Steinberg | | |
| 4,503,851 A | 3/1985 | Braunroth | | |

(Continued)

FOREIGN PATENT DOCUMENTS

WO WO 94/19976 A1 9/1994

(Continued)

OTHER PUBLICATIONS

Definition of Quaternary ammonium compounds from inchem. org.*

(Continued)

*Primary Examiner*—Patricia M Bianco
*Assistant Examiner*—Tarla R Patel
(74) *Attorney, Agent, or Firm*—Joseph R. Baker, Jr.; Gavrilovich Dodd & Lindsey LLP

(57) ABSTRACT

A medical face mask comprising a central transparent portion, an outer filter portion and, optionally, one or more antimicrobial agents is described.

17 Claims, 6 Drawing Sheets

U.S. PATENT DOCUMENTS

| | | | | |
|---|---|---|---|---|
| 4,657,010 | A | | 4/1987 | Wright |
| 4,832,017 | A | | 5/1989 | Schnoor |
| 4,848,366 | A | | 7/1989 | Aita |
| 4,856,509 | A | | 8/1989 | Lemelson |
| 4,945,574 | A | | 8/1990 | Dagher |
| 4,965,887 | A | | 10/1990 | Paoluccio et al. |
| 5,433,192 | A | | 7/1995 | Ebeling |
| 5,538,013 | A | | 7/1996 | Brannon |
| 5,538,014 | A | | 7/1996 | Wilson |
| 5,561,863 | A | * | 10/1996 | Carlson, II ..... 2/206 |
| 5,636,628 | A | | 6/1997 | Barnum |
| 5,682,879 | A | * | 11/1997 | Bowers ..... 128/206.19 |
| 5,891,508 | A | | 4/1999 | Barnum |
| 6,026,511 | A | | 2/2000 | Baumann et al. |
| 6,173,712 | B1 | | 1/2001 | Brunson |
| 2005/0107256 | A1 | * | 5/2005 | Barnwell et al. ..... 504/117 |

FOREIGN PATENT DOCUMENTS

| | | | |
|---|---|---|---|
| WO | WO 9419976 | A1 * | 9/1994 |
| WO | WO 96/10343 | A1 | 4/1996 |

OTHER PUBLICATIONS

Division of Tuberculosis Elimination, "Fact Sheets—Respiratory Protection" Jan. 21, 2004 , U.S. Department of Health and Human Services, www.cdc.gov/nchstp/tb/.

www.natlallergy.com/allergy/products/cart/serch/view_one_spread.txt/spreaddid/1173, Jan. 16, 2004 http://shop.store.yahoo.com/meritline/cdcleanrep.html; Jan. 16, 2004.

http://shop.store.yahoo.com/cdrdvdrmedia/n95remamoma.html; Jan. 16, 2004.

http://www.med-worldwide.com/product20160.html; Jan. 16, 2004.

* cited by examiner

FACE MASK

CROSS REFERENCE TO RELATED APPLICATIONS

The present application is a U.S. National Stage Application filed under 35U.S.C. §371 which claims priority to International Application No. PCT/US2005/33534, filed Sep. 20, 2005, which claims the benefit under 35U.S.C. §119(e)(1) of U.S. Provisional Application Ser. No. 60/611,856, filed Sep. 20, 2004, the disclosures of which are incorporated herein by reference in entirety.

TECHNICAL FIELD

The present invention relates to universal face masks and more particularly to see-through medical face masks. The masks optionally include one or more antimicrobial agents and/or odor-eliminating or masking agents.

BACKGROUND

Face masks are universally used in the medical profession and elsewhere to reduce the risk of transferring infectious bacteria, virus and the like between the health care provider and the patient (and/or client) or in any context where nose, mouth and eye protection may be indicated. Face masks having a transparent portion over the mouth area of the wearer, such as those described in U.S. Pat. No. 4,323,063, promote better communication between wearer and patient, reduce patient anxiety and improve the compliance of caregivers wearing the masks.

Nonetheless, there exists a need for face masks that provide a more effective barrier to air-borne contaminants such as bacteria and viruses while still providing for improved communication between health care personnel and the patient.

SUMMARY

This invention provides a face mask that is adapted to fit over the nose, mouth and chin of the wearer and to conform at its edges reasonably closely to the face and neck of the wearer. The mask may also include an eye shield.

Thus, in one aspect, the invention is directed to a face mask comprising (a) a transparent central portion; (b) an outer portion surrounding and secured to the central transparent portion; (c) a head strap affixed to the outer portion or transparent portion; and (d) one or more antimicrobial agents. The antimicrobial agent can be coated onto the central portion and/or the outer portion, or can be embedded into the central portion and/or the outer portion, or can be present in a pull-away strip. Moreover, the antimicrobial agent can be one or more biquanides, phenols, phenol derivatives, isothiazolones, metals, ammoniums, alcohols or combinations thereof. In particular embodiments, the antimicrobial agent comprises triclosan.

The central portion of the mask can be adapted to be positioned over the nose and mouth of the wearer. The central portion can be made of a pliable plastic sheet material.

The central portion can be air-impermeable. Additionally, the head strap can be affixed to the outer portion at two locations. In certain embodiments, the central portion is a plastic preformed into an arcuate configuration.

In further embodiments, the transparent central portion comprises a rigid portion that defines a single conic section that extends into the transparent portion at an approximately 90° angle relative to the top surface of the transparent portion. In certain embodiments, the face mask further comprises two further rigid portions that define two further conic sections in the transparent portion, each of the two further rigid portions positioned at approximately 90° relative to each of the side surfaces of the transparent portion of the mask.

In additional embodiments, the face mask further comprises a pull-away strip comprising an agent selected from the group consisting of an odor-eliminator, an odor-neutralizer, a deodorizer, a disinfectant, an odor-emitter, a chemical neutralizer, a smoke-absorbing agent, and an anti-nausea agent.

In yet further embodiments, the invention is directed to a face mask comprising (a) a transparent central portion; (b) an outer portion surrounding and secured to the central transparent portion; (c) a head strap affixed to the outer portion or transparent portion; and (d) one or more pull-away strips present on the outer portion or transparent portion.

In certain embodiments, the pull-away strip comprises an agent selected from the group consisting of an odor-eliminator, an odor-neutralizer, a deodorizer, a disinfectant, an odor-emitter, a chemical neutralizer, a smoke-absorbing agent, and an anti-nausea agent. The agent can be present in microcapsules embedded in a substrate layer on the pull-away strip. The substrate layer can comprise an adhesive and the pull-away strip can further comprise an upper layer configured to peel away from the substrate layer.

In yet additional embodiments, the invention is directed to a face mask comprising (a) a transparent central air-impermeable portion adapted to be positioned over the nose and mouth of the wearer, wherein the central portion is a plastic preformed into an arcuate configuration; (b) an outer portion surrounding and secured to the central transparent portion; (c) a head strap affixed to the outer portion at two locations; and (d) one or more pull-away strips present on the outer portion or transparent portion, wherein the pull-away strip comprises (i) an adhesive substrate layer comprising microcapsules comprising an agent selected from the group consisting of an odor-eliminator, an odor-neutralizer, a deodorizer, a disinfectant, an odor-emitter, a chemical neutralizer, a smoke-absorbing agent, and an anti-nausea agent; and (ii) an upper layer affixed to the substrate layer and configured to peel away from the substrate layer.

In certain embodiments, the face masks described herein meet the criteria for use as an N95 respirator. In other embodiments, the face masks meet the criteria for standard mask protection. Any of the face masks described herein may include a "use" indicator, for example an indicator that turns color when it is time to change the mask.

In still other embodiments, one or more designs or illustrations may be placed on the mask to further aid in bonding between the wearer and the subject. For example, familiar characters (e.g., cartoon characters) or images (or illustrations) of animals, flowers, and the like, may be placed on the mask. The images may be on one or more portions of the mask, although they preferably do not entirely block the view of the wearer's mouth.

These and other embodiments of the subject invention will readily occur to those of skill in the art in light of the disclosure herein.

DETAILED DESCRIPTION OF THE INVENTION

Face masks as described herein find use in various indications, including in health care, surgery, dental applications, research labs, clean rooms, construction sites, air travel, veterinarian applications, cosmetology, environmental settings and the like. Methods of making and using these masks also form aspects of this invention.

All publications, patents and patent applications cited herein, whether above or below, are hereby incorporated by reference in their entirety.

It must be noted that, as used in this specification and the appended claims, the singular forms "a", "an", and "the" include plural referents unless the content clearly dictates otherwise. Thus, for example, reference to a device comprising "an antimicrobial agent" includes devices comprising two or more antimicrobial agents.

Figure 1:
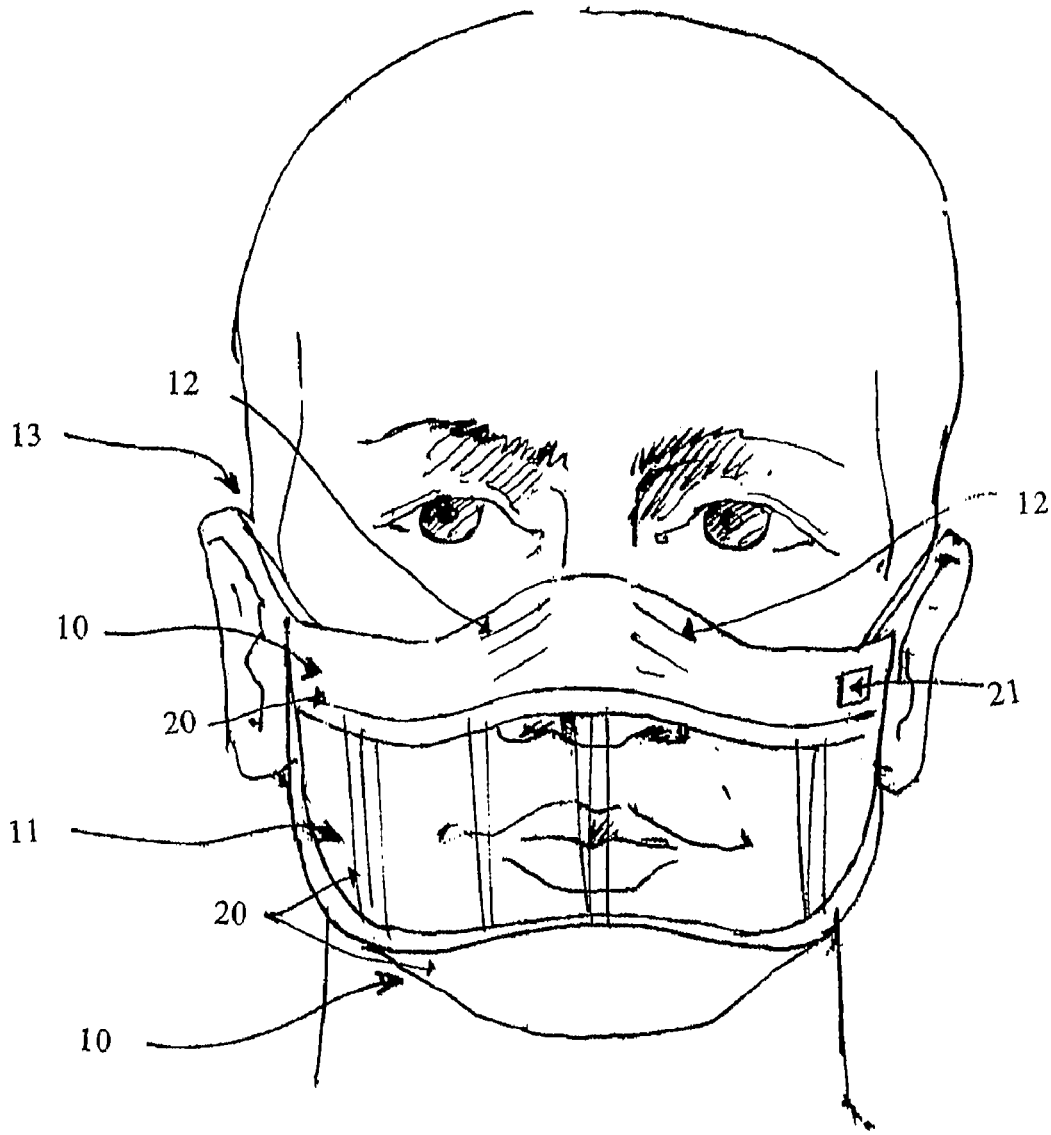
FIG. 1 is a front view of an exemplary face mask described herein shown over the face of a wearer. The face mask includes a transparent portion such that the mouth of the wearer is visible.
Figure 2:
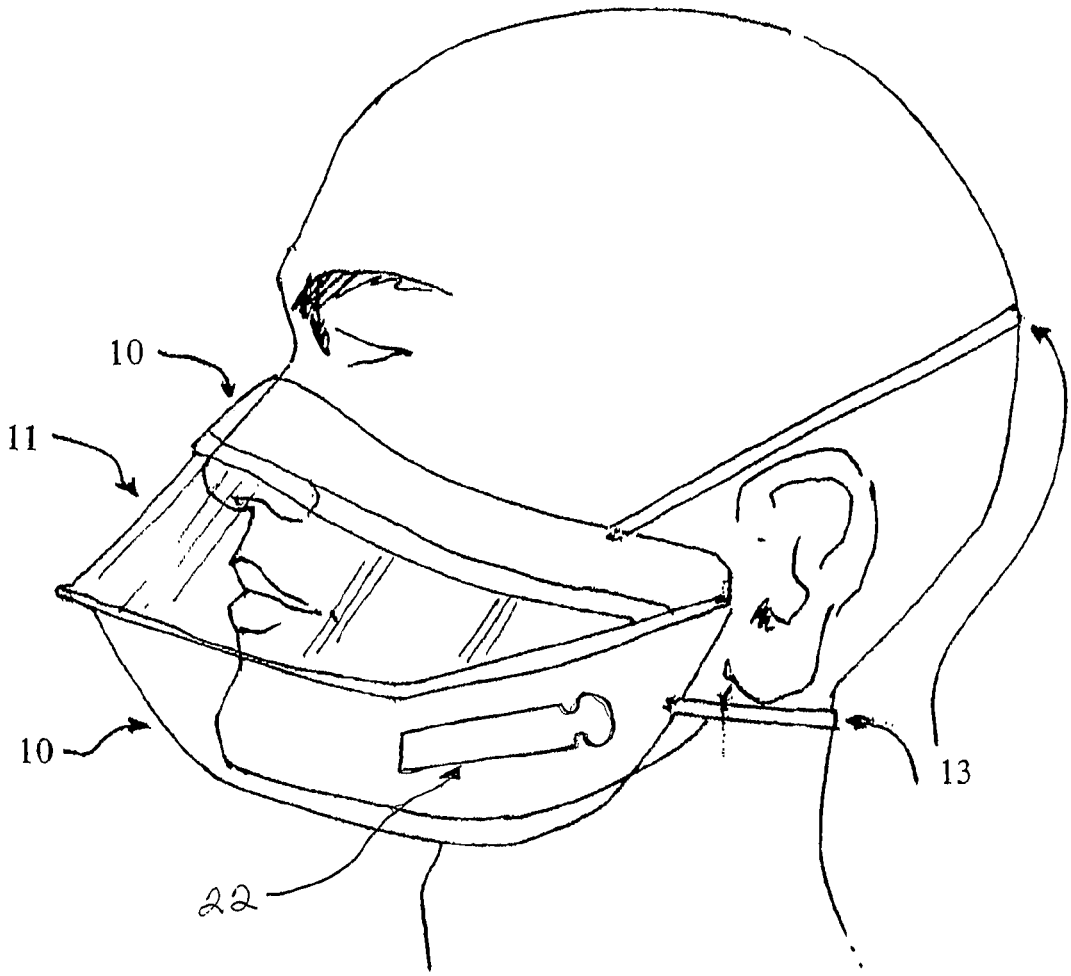
FIG. 2 is a side view of the mask of FIG. 1.
Figure 3:
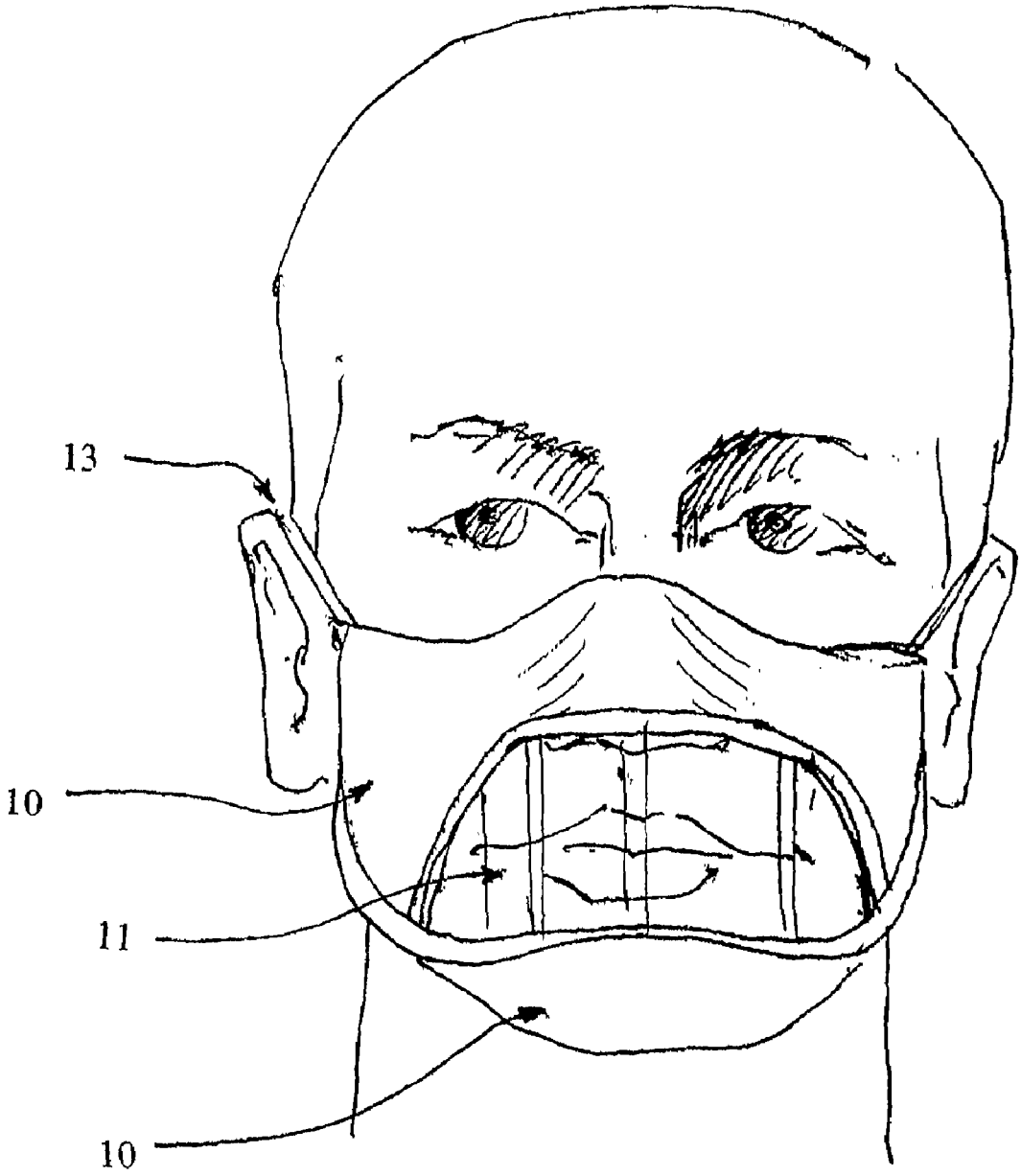
FIG. 3 is a front view of another exemplary face mask described herein shown over the face of a wearer. The face mask includes a transparent portion that is smaller than that shown in the embodiment of FIG. 1.
Figure 4:
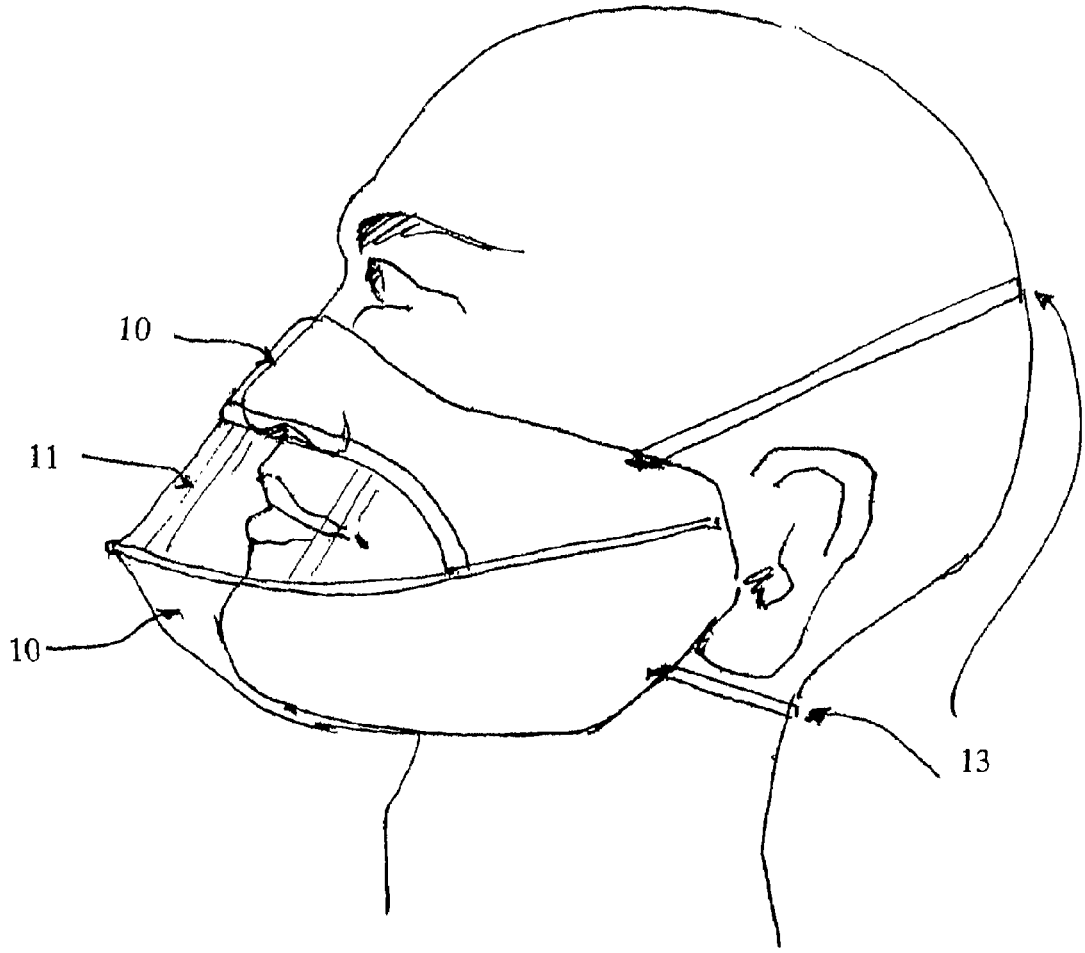
FIG. 4 is a side view of the mask of FIG. 3.

FIGS. 1 and 2 are front and side view depictions, respectively, of an exemplary face mask according to the present invention. The mask is a cup-shaped sheet material comprising a central portion 11 and outer annular portion 10 surrounding central portion 11. FIGS. 3 and 4 show front and side views, respectively, of another exemplary embodiment having a smaller transparent central portion 11.

Outer portion 10 is made of a fibrous material and is preferably permeable to air so that the wearer can breathe easily. Non-limiting examples of fibrous materials which can be used for outer portion 10 are cellulosic fiber, glass fiber, mineral fibers, nylon fiber, acrylonitrile fiber, wool or other natural organic fibers, polyester fiber, and the like. Preferably the fibers are formed into a sheet by a random felting procedure rather than being woven although both types are operable in this invention. Since these masks are typically disposable, inexpensive fibers are preferred, e.g. cellulose, glass, and mixtures thereof. The outer portion 10 may also be formed from a flexible fabric laminate of layers of a nonwoven material including, but not limited to, polypropylene nonwovens such as spunbond, meltblown, spunbond (SMS) commercially available from Kimberly-Clark Corporation. See, also, U.S. Pat. No. 5,561,863.

The outer fibrous portions described herein will preferably filter out the majority of contaminants. Optionally, such filters can be present in the central transparent portion. In fact, filter assemblies may be mounted at any location on the mask, so long as sight is not obstructed. In certain embodiments, the face masks meet the National Institute for Occupational Safety and Health (NIOSH) standards for certification as an N-series filter, also known as N95 because they have been certified to filter particles of about 1 micrometer or greater in size with a 95% efficiency, given flow rates of up to 50 liters per minute. In the masks described herein, N95 type filters are preferred when the health care worker may be exposed to, for example, *M. tuberculosis*, or the causative agent of SARS, as well as other infectious air-borne contaminants. As noted below, outer portion 10 preferably comprises one or more antimicrobial agents.

In additional embodiments, the face masks are adapted for filtering biologically and/or chemically hazardous substances, such as pathogens, particulates and aerosols, to provide safe breathable air to the wearer during chemical and biological warfare, as well as during toxic waste clean-up, fires, in industrial environments, and the like. The face mask of the present invention therefore provides the wearer with suitable protection against biological and chemical atmospheric fallout while minimizing the limitations and problems associated with conventional full-face respiratory masks. This can be accomplished using filters well known in the art and described in e.g., U.S. Pat. Nos. 6,763,835, 6,344,071 and 5,957,131, incorporated herein by reference in their entireties.

For example, extended surface area substrate particles, such as activated carbon, alumina, zeolites, etc., are capable of removing a wide range of different materials. Impregnated carbon can be used to provide filtering capabilities for lower boiling point gases. Chromium can be used as a carbon impregnant and is capable of removing hydrogen cyanide and cyanogen chloride (CK). The filter medium can include at least two kinds of filter media particles, such as an extended surface area substrate with a transition metal impregnant and a second extended surface area substrate with an amine impregnant. See, e.g., U.S. Pat. No. 6,344,071, incorporated herein by reference in its entirety. In certain embodiments, a chemical filter can be made from a carbon-loaded web, such as CALGON ASZM-TEDA, available from 3M Corporation. The web media can be loaded to e.g., 300 grams/$m^2$ of carbon loading material and layered to provide effective chemical protection, and may include a number of layers of carbon loading material. See, e.g., U.S. Pat. No. 6,763,835, incorporated herein by reference in its entirety. A high efficiency particulate air (HEPA) filter for removing particulate and biological agents may also be used and may include a charcoal bed for providing chemical vapor and gas protection.

It is noted that the present invention is not limited to the above filtering media and may include the use of any suitable filtration media with low airflow resistance effective for chemical and particulate filtration, and the like.

In certain embodiments, for example as shown in FIGS. 2 and 4, it is desirable to employ a certain amount of material in the mask that will permit molding the mask into a beak-like shape so it will project outwardly somewhat from the nose and mouth. This stiffening or moldable characteristic can be provided by incorporating moldable fibers into the felted material or by use of a small amount of a suitable coating on the fibers or an adhesive applied to the felted material. The beak-like shape aids in directing the flow of air (exhalation and inhalations) downward and generally perpendicular to the object or person in face-to-face orientation with the wearer.

Central portion 11 of the mask is made of a transparent material that is also generally air-impermeable so that the wearer's breath is directed onto this portion, is diverted sidewise in all directions and permeates through the air-permeable outer portion 10 of the mask. The term "transparent" refers to any material which permits a sufficient amount of visible light having wavelengths within the range of about 3900 angstroms to about 7700 angstroms to pass therethrough such that a viewer on one side of such material may discern an object or a feature of an object on the other side of and in relatively close proximity to such material. Thus, the term encompasses materials that are translucent, tinted, frosted or the like.

The central transparent portion 11 is of sufficient size and is secured to the outer filter portion 10 so as to permit viewing of at least a portion of at least one and preferably both of the wearer's lips. In use, the central portion 11 can be positioned adjacent to the nose and mouth of the wearer. The lower outer portion 10 is typically positioned below the wearer's mouth and generally captures the wearer's chin. By making central portion 11 transparent, the mouth and adjacent portions of the face can be seen when the mask is worn. This permits facial expressions and lip movements to be seen which is of great assistance in understanding what the wearer is saying. Furthermore, in the treatment of patients who are under some stress and anxiety, it is believed that seeing a smile through the mask is an important factor in relieving that stress and anxiety. It is, of course, well known that being able to see the lip movements of a person speaking materially increases the chance of understanding what is being said. Thus, the preferred embodiment of this invention provides a mask with a longer useful life and greatly enhances the ability of the wearer of the mask to communicate his thoughts and feelings to another.

The materials from which the central, typically transparent portion 11 is constructed are preferably films of synthetic plastic materials such as ionomer resins, polyolefins, polyesters, polyamides, vinyl polymers, cellulose esters, and/or polycarbonates. These materials are available as transparent films. Non-limiting examples of commercially available materials for use as the central portion include Surlyn® (DuPont, Wilmington, Del.); polyesters such as Mylar® (a polyethylene terephthalate polyester made by DuPont) and Dura-Lar® (Grafix Plastics); acetates and/or vinyl polymers such as Clear-Lay® (a PVC film sold by Grafix Plastics). The material may further be ridged, flexible, pliable or premolded. Additionally, a non-fogging or fog-resistant coating may be applied to such materials. Examples of suitable non-fogging or fog-resistant coatings include, but are not limited to, silicone coatings and floro-chemical coatings.

The particular thickness of the transparent portion material is not critical to the face masks described herein and may range from approximately 0.0025 inches to 0.01 inches or more in thickness.

When the mask is made of a combination of felted fibrous sheet material in outer portion 10 and synthetic plastic film in central portion 11, the two portions may be joined to each other by stitching, cementing, the application of adhesive tape to overlapping edges, or any other means which provides a tight seal.

Most of the synthetic plastic films are capable of being heat-molded into a cup-shape, or arcuate configuration by heating flat film to the softening temperature of the film, shaping the plastic into the desired shape and then cooling the shaped film to room temperature while maintaining the film under the shaping force.

In certain embodiments, the clear portion may further comprise one or more rigid portions that define one or more conic sections of the clear portion. See, FIGS. 7 and 8. Generally, the rotational angle or diameter of the conic section(s) is(are) defined by the face of the user and/or by one or more rigid portions. Typically, however, the forward angle or protruding angle of the mask is defined by other parameters such as the bridge of the nose, tightening of the mask, etc. In certain embodiments, the interface between a human face and mask can be defined by a set of conic sections and the rigid portion(s) aid in conforming the clear portion of the mask to the face of the wearer, such that the mouth is visible to the patient and such that breathability for the wearer is maintained.

The rigid portions may be made from inserted materials including but not limited, to metal, polymers or combinations thereof such as wires, ribbons, bands, and the like. Alternatively, the material making up the clear portion may be modified (e.g., heated, etc), such that it becomes more rigid in the desired locations. The rigid portion(s) may be clear or opaque, so long as they do not entirely obscure the wearer's mouth, particularly the lower lip.

It will also be apparent that the rigid portions may be positioned anywhere on the mask, so long as they do not entirely obscure the wearer's mouth and so long as the mask maintains the desired conformation (seal) to the wearer's face. Furthermore, the size of the rigid portion(s) can also vary, for example to vary the steepness of the conical section created by the rigid portion(s).

Figure 7:
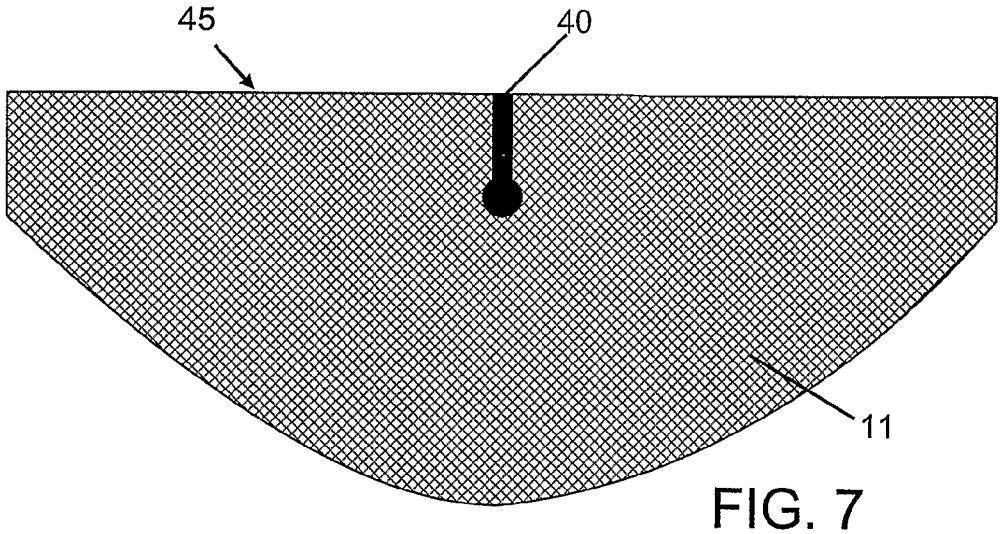
FIG. 7 shows another exemplary embodiment of a mask of the present invention that includes a rigid portion at an approximately 90° angle relative to the top surface of the transparent portion of the mask. The rigid portion aids in maintaining the conical shape of the transparent portion.

FIG. 7 shows an exemplary embodiment in which the clear portion 11 includes a rigid portion 40 that defines a single conic section in the clear portion that has a shape that can be integrated into a duckbill style surgical face mask. In the embodiment shown in FIG. 7, the rigid portion 40 is positioned near the middle of the top surface 45 of the clear portion 11 and extends into the clear portion 11 at an approximately 90° angle relative to top surface 45 of the clear portion 11. As noted above, the rigid portion may aid in conforming the clear portion 11 to the face of the wearer.

Figure 8:
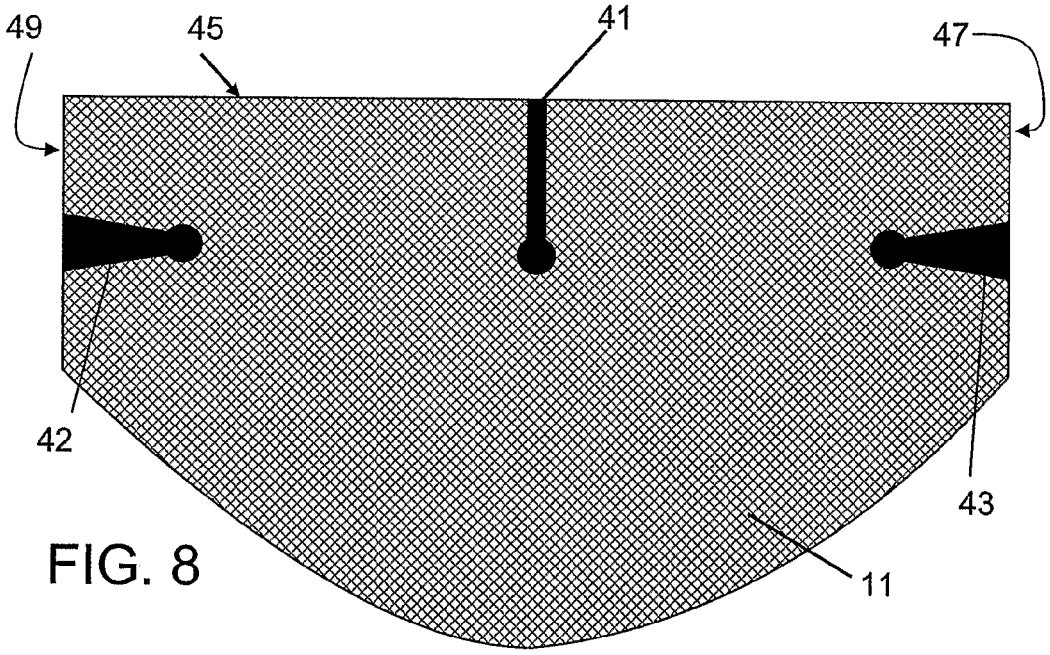
FIG. 8 shows an exemplary embodiment similar to that shown in FIG. 7 having 3 rigid portions. In this exemplary embodiment, one rigid portion is positioned at an approximately 90° angle relative to the top surface of the transparent portion; another rigid portion is positioned at an approximately 90° angle relative to one side of the surface of the transparent portion; and another rigid portion is positioned at an approximately 90° angle relative to the other side surface of the transparent portion.

FIG. 8 shows an embodiment in which two conic sections are created in the clear portion 11 using multiple rigid portions 41, 42, 43 positioned at approximately 90° relative to the top 45 and side 47, 49 surfaces of the clear portion 11. One conic section has a steeper angle than the first, thereby increasing the visible portion of the face while still conforming to the face of the user. Thus, multiple rigid portions can be positioned appropriately to produce a controlled slope angle on the front of the mask thereby creating more visible facial features, especially the lower lip.

The face masks described herein may also include one or more antimicrobial agents 20. These agents may be present in the outer 10 and/or inner 11 portions. In certain embodiments, the antimicrobial agent(s) are found in both the outer and inner portions. A wide variety of antimicrobial agents can be used in the face masks described herein. Preferably, the antimicrobial agents have been previously used and may have the ability to be efficacious and safe for use in humans. Non-limiting examples of suitable antimicrobial agents include biquanide, isothiazolones, metals, alcohols, silver-loaded zeolites (B F Technologies, located in Beverly, Mass., sold under the trademark HEALTHSHIELD™), phenol or phenol derivatives such as short chain alkyl esters of p-hydroxybenzoic acid, commonly known as parabens; N-(4-chlorophenyl)-N'-(3,4-dichlorophenyl) urea, also known as 3,4,4'-trichlorocarbanilide or triclocarban; 2,4,4'-trichloro-2'-hydroxy diphenyl ether, commonly known as triclosan (Irgasan DP300 from Ciba Specialty Chemicals Corp., Tarrytown, N.Y., USA), ammoniums (e.g., bacteriostatic quaternary ammonium compounds such as benzalkonium chloride, benzethonium chloride, cetyl pyridium chloride, lauryl pyridium chloride and methyl benzethonium chloride); zinc phenol sulfonate; zinc ricinoleate; triethyl citrate; chitosan or chitin derivatives and combinations thereof and the like. Preferred antimicrobial agents include triclosan, compounds based on heavy metals, especially silver, or inorganic carriers such as zeolites, hydroxyapatite, zinc oxide, titanium dioxide, zirconium phosphate, isothiazolones, benzisothiazolin-3-one derivatives, 10,10' oxybisphenoxyarsine, isothiazolines, zinc pyrithione, folpet (trichloromethyl thio-phthalimide).

The antimicrobial agent(s) may be included in one or more regions of the mask. For instance, these agents may be found in combination with the central portion and/or some or all of the outer portion. Typically, antimicrobial agents are not included in the headstrap. In one embodiment, the antimicrobial agent is present in a pull-away strip 22, that is attached to the mask. Such strips are described in more detail below.

The concentration of antimicrobial agent(s) used in the masks described herein will be sufficient to act as an antimicrobial and make the mask more durable, but not cause adverse reactions in the wearer. The skilled artisan can readily determine such concentrations in view of the teachings herein.

The antimicrobial agent(s) may be coated onto, or embedded into the outer and/or inner portion of the face mask using any suitable method (e.g., spray-deposition, etc.) or, alternatively, may be incorporated into the outer and/or inner element(s) during production. See, e.g., U.S. Pat. No. 6,632,855.

As shown in FIG. 1, in certain embodiments the masks described herein may also include a nose clip 12, for example in the form of a thin strip of a manually bendable material such as a soft metallic alloy of lead, zinc, aluminum, thin gauge steel and the like. Nose clip 12 will typically bend readily upon finger manipulation and retains the bend with reasonable stability. Nose clip 12 may be affixed by stitching, cementing, or the like to the upper portion of the mask and may be pinched around the bridge of the nose to assure that edges of the mask fit reasonably tightly against the face so as to aid in forming a more effective seal against the passage of bacteria or virus.

FIG. 1 also shows use indicator 21 which may be included in certain embodiments to alert the wearer when to change the mask. Use indicator 21 may be positioned anywhere in the mask, although it is preferably positioned on the non-transparent outer portion 10. Any suitable substance can be used to indicate that it is time to replace the mask including, but not limited to, photosensitive materials that change color or pattern over time, moisture or temperature sensitive materials that change color over time, dyes, etc. For example, a photosensitive material that darkens over time upon exposure to light can be included in the mask. Upon first donning the mask, the wearer can remove a protective cover from the use indicator that shields it from light prior to use. Similarly, a moisture- or temperature-sensitive material can be used that changes color when exposed to the moisture and/or heat of the wearer's breath and/or skin. A non-limiting example of a substance that changes color upon exposure to moisture is phenolpthalein. Other moisture-sensitive materials will be known to those of skill in the art in view of the teachings herein. Alternatively, the use indicator may comprise a dye or other substance that reflects usage of the mask. In other embodiments, the use of indicator may comprise a use-indicating adhesive or tape demonstrating use. One or more different use indicators can be used in the same mask. Use indicator 21 may include a legend or be graded to further clarify whether the mask should be changed.

Attached to the mask (e.g., on each side) is a strap 13 used to hold the mask in place. The terms "hold," "join," "secure," "attach" and derivatives and synonyms thereof refer to any affixing of such structure(s) of the present invention to another structure(s) and may be accomplished by any of several conventional methods. Thus, straps may be secured by use of elastic materials, by tying or any other suitable mechanism that holds the mask in place. By way of example and not limitation, these methods include stitching, gluing, heat sealing, zipping, snapping, sonic or thermal bonding or using a hook and loop fastening system and other methods familiar to those skilled in the art. Head strap 13 is any suitable strap or plurality of straps that will hold the mask tightly against the face of the wearer. A single elastic strap is normally sufficient, although two or more may be used. Alternatively, the head strap may comprise one or more pairs of tapes fastened to the mask at only one end such that each pair may be tied together to produce one restraining head strap 13. Head strap 13 may be attached to the mask outer portion 10 by any suitable fastener including, but not limited to, metal staples, stitching, cementing, riveting, or the like.

In certain embodiments, as shown in FIG. 2, one or more pull-away strips 22 is present on the face mask. The pull-away strip can be provided individually and then affixed to the mask by the wearer or may be provided as part of the mask. The strip can include, without limitation, an antimicrobial agent as described above, an odor-eliminator or neutralizer, a deodorizer, a disinfectant, an odor-emitter such as a fragrance, a chemical neutralizer, a smoke-absorbing agent, and/or an anti-nausea agent to suppress vomiting e.g., on an airplane or boat, etc. For example, it may be desirable for the wearer of the face mask to eliminate or mask odors such as vomit, decay, etc. One convenient means of doing so is to use a strip impregnated with the odor-eliminating or odor-masking agent of interest encapsulated in polymeric microcapsules. In this embodiment, the microcapsules remain intact until a force is exerted, such as by peeling off a top layer on the pull-away strip. The microcapsules then break open and the agent inside is released. Thus, the mask wearer can, at his or her own discretion, pull on the strip when desired in order to release the agent in the microcapsules. It is to be understood that the term "microcapsule" as used herein includes true microcapsules, i.e. microparticles in which an active ingredient is enclosed by a polymeric matrix, as well as monolithic microcapsules (microspheres) in which an active ingredient is homogeneously distributed in a polymeric matrix.

Generally, the force required to remove the top layer can be modified by decreasing the width of the strip and increasing the length. The surface area of the strip may remain sufficiently large to be efficacious for the target use. The total amount of chemical dispersal required will depend on numerous parameters, such as concentration and evaporation rates. However, once a specified volume has been chosen, a suitable strip width can then be chosen to minimize the pull force required. More specifically, the pull force ideally remains below the force exerted by the strap used to hold the mask in place, thereby preventing the mask to snap back on the user's face when the strip is pulled.

Multiple strips can be present on the face mask, each strip with microcapsules including the same agent as the other strips, or with microcapsules including different agents. For example, one or more strips can include an antimicrobial agent while another strip can include an odor-eliminating agent. In other embodiments, multiple strips, each with different scents, are included on the mask so the wearer, such as a child, can choose a pleasing scent.

Figure 5:
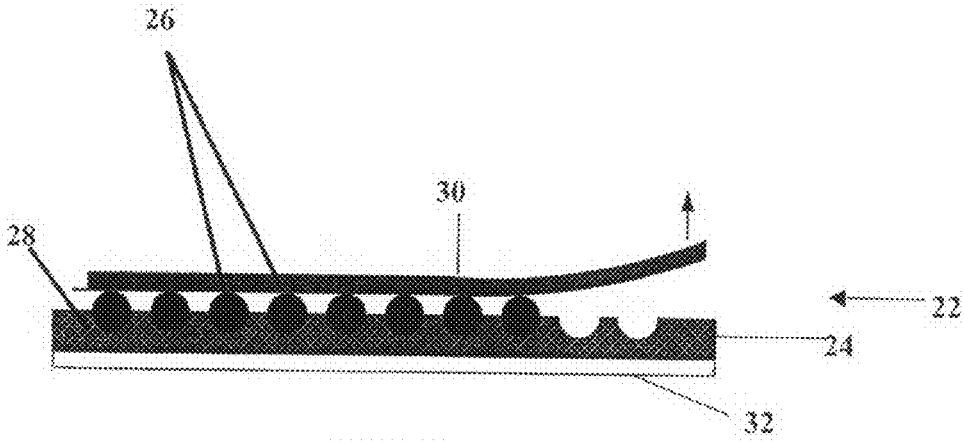
FIG. 5 shows an exemplary pull-away strip for use with the mask.

Referring now to FIG. 5, the strip 22 generally includes a substrate layer 24 that is formed by microcapsules 26 embedded in an adhesive 28, such as a glue. An upper layer 30 is placed on top of the substrate layer, generally while the adhesive is still wet. A lower layer 32, can also be present and located beneath the substrate. The upper layer is configured so that it will peel away from the substrate layer when pulled by the wearer of the mask. The upper and lower layers can be paper or any suitable polymer. The lower layer can be made of material that allows the pull-away strip to be affixed to the mask.

Figure 6A:
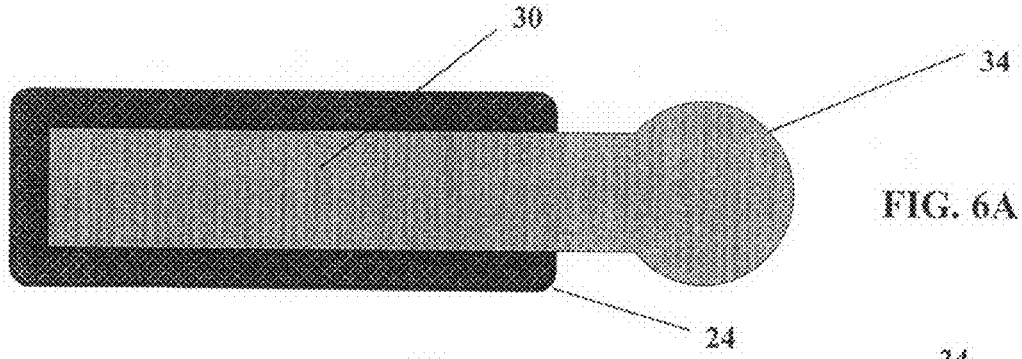
FIGS. 6A, 6B and 6C show alternative embodiments of the pull-away strip for use with the mask.
Figure 6B:
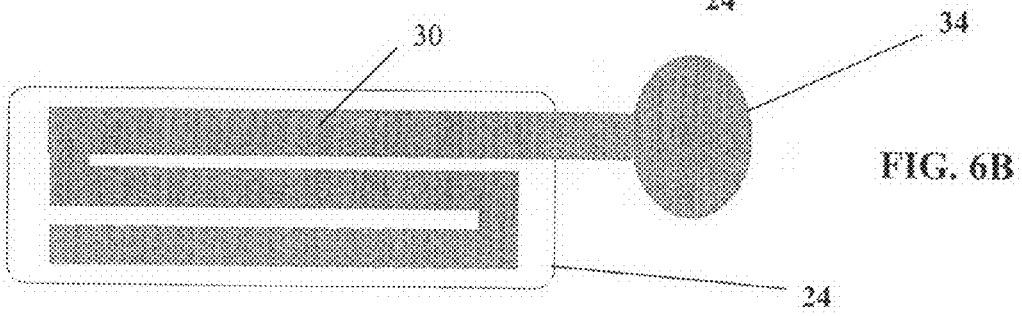
Figure 6C:
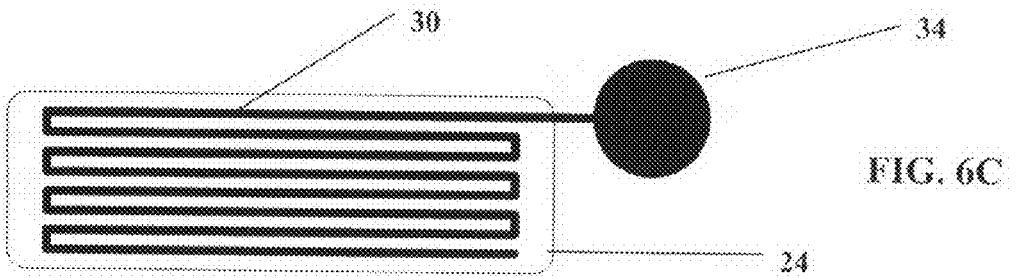

The substrate layer 24 (and hence the upper layer 30) can take on any one of a variety of shapes including but not limited to, a ribbon-like shape, a patch-like shape, a band aid shape, a zig-zag shape, a spiral, etc. Representative shapes for the substrate layer 24 (and hence the upper layer 30) are shown in FIGS. 6A, 6B and 6C. As shown in FIGS. 6A-6C, The pull-away strip can also include a tab 34 to ease in pulling the upper layer 30 away from the substrate layer 24. However, the upper layer can be configured in any of other several ways to allow it to be pulled away from the substrate layer. For example, the upper layer can include a slit so that it can be pulled away from the substrate layer in opposite directions, much like a band aid.

Methods of encapsulating agents of interest are well known in the art and include, for example, air-suspension coating techniques, such as pan coating and Wurster coating, as described by Hall et al., (1980) The "Wurster Process" in *Controlled Release Technologies: Methods, Theory, and Applications* (A. F. Kydonieus, ed.), Vol. 2, pp. 133-154 CRC Press, Boca Raton, Fla. and Deasy, P. B., *Crit. Rev. Ther. Drug Carrier Syst*. (1988) S(2):99-139; and ionic gelation as described by, e.g., Lim et al., *Science* (1980) 210:908-910.

U.S. Pat. No. 5,503,851, incorporated herein by reference in its entirety, provides methods for the microencapsulation of water-soluble active ingredients by phase separation. Another method of microencapsulation is the use of chemical vapor deposition, such as deposition of polymeric films, including, but not limited to, polymers such as poly-p-xylylene (PARYLENE, Union Carbide Co.) polyolefins including polyethylene, polymethylene, polymethylmethacrylate, silicones such as polydimethylsiloxane, polyfluorinated hydrocarbons such as chlorotrifluoroethylene, tetrafluoroethylene, and also polymers formed from unsaturated monomers such as styrene, and the like. Such methods and materials are described in detail in U.S Pat. No. 5,393,533, incorporated herein by reference in its entirety.

Microcapsules can also be formed using spray-drying and coacervation as described in, e.g., Thomasin et al., *J. Controlled Release* (1996) 41:131; U.S. Pat. No. 2,800,457; Masters, K. (1976) *Spray Drying* 2nd Ed. Wiley, N.Y., all incorporated herein by reference in their entireties. Coacervation involves forming a droplet dispersion in water. The size of the droplets determines capsule size. In this method, a wall is formed out of the surrounding water solution and deposited and hardened around the oil droplet, after which the capsules are washed and resuspended in water. The microcapsules produced include a central reservoir of the agent of interest surrounded by a hard, wall or shell. The wall materials may be urea-formaldehyde or various forms of gelatin.

The microcapsules are generally 10-1000 microns in size, more typically 50-500, and even more typically 100-400 microns. Particle size can be determined by, e.g., laser light scattering, using for example, a spectrometer incorporating a helium-neon laser. Generally, particle size is determined at room temperature and involves multiple analyses of the sample in question (e.g., 5-10 times) to yield an average value for the particle diameter. Particle size is also readily determined using scanning electron microscopy (SEM).

The adhesive used in the pull-away strip is typically a fugitive adhesive, i.e., an adhesive with poor cohesive strength but good adhesive ability. When a fugitive bond is broken, the adhesive generally breaks down the center. When two sheets of paper are bound together, the adhesive releases so the paper will come apart intact without rupturing. A fugitive adhesive is generally in liquid form, e.g., an emulsion or solution, with a solids content of about 25-40%, and a high viscosity. The capsule slurry is blended with the adhesive using a low shear method.

Paper or polymers for use as the upper and lower layers of the pull-away strips is selected for smoothness, gloss and ability to handle two-sided coating. It should have neutral pH so no acidity affects the adhesive/capsule slurry. The paper also should have good physical stability because the adhesive/capsule strip is dried on the paper by diffusion of the water into the paper, a process that can cause puckering and a consequent wavy appearance in the area of the strip. The capsules are caught between the two sheets of paper, and when the paper is pulled apart, the fugitive adhesive breaks down the middle to force the capsule halves to go with their respective paper or polymer side.

One convenient method of producing the pull-away strip is with the bindery section of a printing operation using a printing press and binder. A desired glue is provided and the bindery section performs gluing, folding, slitting, perforating and butt-cutting, applies the slurry of adhesive and capsules, and folds over the paper to form the pull-away strip of interest. The adhesive is applied to the paper by a printing or extrusion operation.

The pull-away strip can be placed in any convenient location on the mask, so long as the wearer is able to access it during use. For example, as shown in FIG. 2, the pull-away strip 22 can be placed on the side of the mask. Alternatively, the pull-away strip can be placed over the bridge of the nose, under the nose, inside the mask, etc. As explained above, in certain embodiments, the pull-away strip can be provided individually and then affixed to the mask by the wearer.

In certain embodiments, the mask may also include one or more images or illustrations at one or more positions. The use of familiar characters (e.g., cartoon characters) or images (or illustrations) of animals, flowers, and the like, may aid in decreasing anxiety, providing a distraction and/or providing a familiar, comforting image to the patient (e.g., pediatric patients). The images may be on one or more portions (e.g., outer and/or central portion) of the mask, although they preferably do not entirely block the view of the wearer's mouth.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed is:

1. A face mask comprising (a) a transparent air-impermeable central portion that directs a wearer's breath downward;

(b) an air-permeable outer portion surrounding and secured to the central transparent portion;

(c) a head strap affixed to the outer portion or transparent portion;

(d) one or more antimicrobial agents coated onto or embedded into the air-permeable outer portion; and (e) a rigid portion that defines a single conic section that extends into the transparent portion at an approximately 90° angle relative to the top edge of the transparent portion to form a beak-shaped mask.

2. The face mask of claim 1, wherein the central portion of the mask is adapted to be positioned over the nose and mouth of the wearer.

3. The face mask of claim 1, wherein the head strap is affixed to the outer portion at two locations.

4. The face mask of claim 1, wherein the central portion is air-impermeable.

5. The face mask of any one of claims 1-4 wherein the central portion is a plastic preformed into an arcuate configuration.

6. The face mask of claim 1, wherein the central portion is a pliable plastic sheet material.

7. The face mask of claim 1, further comprising the antimicrobial agent coated onto the central portion.

8. The face mask of claim 1, further comprising the antimicrobial agent embedded into the central portion.

9. The face mask of claim 1, wherein the antimicrobial agent is selected from the group consisting of biquanides, phenols, phenol derivatives, isothiazolones, metals, ammoniums, alcohols and combinations thereof.

10. The face mask of claim 9, wherein the antimicrobial agent comprises triclosan.

11. The face mask of claim 1, further comprising a one or more pull-away strips comprising microcapsules containing an agent selected from the group consisting of an antimicrobial agent, an odor-eliminator or neutralizer, a deodorizer, a disinfectant, an odor-emitter, a chemical neutralizer, a smoke-absorbing agent, an anti-nausea agent to suppress vomiting, and any combination thereof.

12. A face mask comprising (a) a transparent central air-impermeable portion adapted to be positioned over the nose and mouth of the wearer, wherein the central portion is a plastic preformed into an arcuate configuration that directs a wearer's breath downward;

(b) an air permeable outer portion surrounding and secured to the central transparent portion;

(c) a head strap affixed to the outer portion at two locations;

(d) one or more antimicrobial agents coated onto or embedded into the air permeable outer portion; and (e) a rigid portion that defines a single conic section that extends into the transparent portion at an approximately 90° angle relative to the top edge of the transparent portion to form a beak-shaped mask.

13. The face mask of claim 12, wherein the antimicrobial agent is selected from the group consisting of biquanides, phenols, phenol derivatives, isothiazolones, metals, ammoniums, alcohols and combinations thereof.

14. The face mask of claim 13, wherein the antimicrobial agent comprises triclosan.

15. The face mask of claim 12, further comprising the antimicrobial agent coated onto the central portion.

16. The face mask of claim 12, further comprising the antimicrobial agent embedded into the central portion.

17. The face mask of claim 12, further comprising a one or more pull-away strips comprising microcapsules containing an agent selected from the group consisting of an antimicrobial agent, an odor-eliminator or neutralizer, a deodorizer, a disinfectant, an odor-emitter, a chemical neutralizer, a smoke-absorbing agent, an anti-nausea agent to suppress vomiting, and any combination thereof.

* * * * *